US011848184B2

(12) United States Patent
Nishiguchi

(10) Patent No.: US 11,848,184 B2
(45) Date of Patent: Dec. 19, 2023

(54) MASS SPECTROMETER

(71) Applicant: SHIMADZU CORPORATION, Kyoto (JP)

(72) Inventor: Masaru Nishiguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 289 days.

(21) Appl. No.: 17/297,241

(22) PCT Filed: Dec. 19, 2018

(86) PCT No.: PCT/JP2018/046885
§ 371 (c)(1),
(2) Date: May 26, 2021

(87) PCT Pub. No.: WO2020/129199
PCT Pub. Date: Jun. 25, 2020

(65) Prior Publication Data

US 2022/0293408 A1 Sep. 15, 2022

(51) Int. Cl.
*H01J 49/06* (2006.01)
*H01J 49/42* (2006.01)

(52) U.S. Cl.
CPC ..... *H01J 49/063* (2013.01); *H01J 49/4215* (2013.01)

(58) Field of Classification Search
CPC ..... H01J 49/063; H01J 49/4215
See application file for complete search history.

(56) References Cited

U.S. PATENT DOCUMENTS 6,107,628 A 8/2000 Smith et al.
6,417,511 B1 7/2002 Russ, IV et al.
(Continued)

FOREIGN PATENT DOCUMENTS

CN 203339108 U 12/2013
EP 2 139 022 A1 12/2009
(Continued)

OTHER PUBLICATIONS

International Search Report for PCT/JP2018/046885 dated Mar. 26, 2019 [PCT/ISA/210].
(Continued)

*Primary Examiner* — Nicole M Ippolito
*Assistant Examiner* — Hanway Chang
(74) *Attorney, Agent, or Firm* — Sughrue Mion, PLLC

(57) ABSTRACT

An ion guide (20) provided in a first intermediate vacuum chamber includes six rod electrodes (211 to 216) and a voltage generation unit. The six rod electrodes (211 to 216) are in a hexapole arrangement on the ion incident side, and the two rod electrodes (211 and 214) are tilted with respect to the Z-axis in a manner approaching a central axis (201) as they progress in the ion transport direction, so that the four rod electrodes (211, 214, 215, and 216) are in a quadrupole arrangement. The voltage generation unit applies radio-frequency voltages ±V cos ωt whose phases are inverted to each other between adjacent rod electrodes of the six rod electrodes (211 to 216) around the central axis (201), applies a DC voltage U1 to the four electrodes (211, 214, 215, and 216) by which ions pass through them in an excellent manner, and applies a DC voltage U2 different from U1 to the other two rod electrodes (212 and 213).

20 Claims, 6 Drawing Sheets

(56) References Cited

U.S. PATENT DOCUMENTS

| | | | | |
|---|---|---|---|---|
| 7,985,951 | B2 * | 7/2011 | Okumura | H01J 49/063 250/281 |
| 2004/0051038 | A1 | 3/2004 | Taniguchi | |
| 2013/0175442 | A1 | 7/2013 | Yamada et al. | |

FOREIGN PATENT DOCUMENTS

| | | | |
|---|---|---|---|
| JP | 2004-111149 | A | 4/2004 |
| JP | 2013-143196 | A | 7/2013 |
| WO | 2008/136040 | A1 | 11/2008 |

OTHER PUBLICATIONS

Written Opinion for PCT/JP2018/046885 dated Mar. 26, 2019 [PCT/ISA/237].
Notice of Allowance dated Jul. 19, 2022 from the Japanese Patent Office in JP Application No. 2020-560714.

* cited by examiner

MASS SPECTROMETER

CROSS REFERENCE TO RELATED APPLICATIONS

This application is a National Stage of International Application No. PCT/JP2018/046885 filed Dec. 19, 2018.

TECHNICAL FIELD

The present invention relates to a mass spectrometer.

BACKGROUND ART

In the mass spectrometer, an ion transport optical system is used to transport ions generated in an ion source to a mass spectrometry unit. The performance of the ion transport optical system greatly affects the performance of the entire mass spectrometer, such as the detection sensitivity of ions and the stability of a detection signal.

In a mass spectrometer using an atmospheric pressure ion source such as an electrospray ionization (hereinafter abbreviated as "ESI") ion source, a plurality of chambers having different degrees of vacuum separated by partition walls are provided between the ion source which has a substantially atmospheric pressure atmosphere and a high vacuum chamber in which a mass spectrometry unit is provided and a high vacuum is maintained. Usually, an ion transport optical system is provided in each of a plurality of the chambers. The ion transport optical system has a function of receiving ions sent from a previous stage, confining the ions, transporting and delivering them to a subsequent stage.

The ion transport optical system provided in a chamber having a relatively low degree of vacuum is often a radio-frequency ion guide that utilizes the cooling action of ions due to collision between ions and residual gas. The radio-frequency ion guides confine ions in a predetermined space and transport them, mainly using a pseudopotential generated by a radio-frequency electric field, and are roughly classified into two types according to their structure.

One type of the radio-frequency ion guides is a multipole ion guide in which four, six, or eight (or more) rod electrodes are arranged so as to surround the ion optical axis (see Patent Literature 1 and the like). In the multipole ion guide, a pseudopotential is generated in the space surrounded by the rod electrodes by application of radio-frequency voltages whose phases are inverted to each other between adjacent rod electrodes around the ion optical axis, so that ions are confined and transported.

The other type of the radio-frequency ion guides is an ion funnel in which a plurality of electrodes having a shape of surrounding ions, such as a disk having a central opening, are stacked in the ion transport direction (see Patent Literature 2 and the like). In the ion funnel, a pseudopotential for reflecting ions is formed in the vicinity of each electrode by application of radio-frequency voltages whose phases are inverted to each other between adjacent electrodes in the ion transport direction, so that ions are confined and transported.

CITATION LIST

Patent Literature

Patent Literature 1: WO 2008/136040 A
Patent Literature 2: U.S. Pat. No. 6,107,628 A

SUMMARY OF INVENTION

Technical Problem

In order to enhance the analytical sensitivity in a mass spectrometer, particularly a mass spectrometer using an atmospheric pressure ion source, it is important to enhance the ion transport efficiency in the ion transport optical system. However, both the multipole ion guide and the ion funnel have problems described below.

The ion confinement ability and ion convergence ability of the multipole ion guide depend on the number of rod electrodes. In general, the ion confinement ability is higher when the number of rod electrodes is larger. However, the ion convergence ability is higher when the number of rod electrodes is smaller. For this reason, there is a dilemma that if one of the ion confinement ability and the ion convergence ability is prioritized, the other is sacrificed. It is difficult to enhance the overall ion transport efficiency by improving both the confinement ability and the convergence ability.

In contrast, the ion funnel has a high ion confinement ability, but the effect of the electric field that converges the ions near the central axis (ion optical axis) of the ion funnel is small. For this reason, in general, the opening diameter of the electrode is configured to be gradually narrowed in the ion transport direction in order to converge ions. However, an electrode with a narrowed opening diameter is easily contaminated by ions and neutral particles. In particular, in the ion funnel, it is necessary to considerably narrow the distance between adjacent electrodes in the ion transport direction. For this reason, neutral particles that enter an ion passage space do not easily pass through the gap between electrodes, and easily collide with the electrodes. For this reason, there is a problem that the above-mentioned contamination is likely to occur, and the electric field is disturbed by the contamination and the performance is easily deteriorated.

An object of the present invention is to provide a mass spectrometer in which analytical sensitivity is improved by solving the problem of the conventional multipole ion guide and the ion funnel as described above and improving the ion transport efficiency.

Solution to Problem

The mass spectrometer according to one aspect of the present invention made to solve the above problem is a mass spectrometer including an ion transport optical system configured to transport an ion to be analyzed.

The ion transport optical system includes

N rod electrodes, N being an even number of six or more, arranged to extend in an ion transport direction as a whole, and a voltage generation unit configured to apply predetermined voltages to the N rod electrodes respectively, the N rod electrodes are in an N-pole arrangement on an ion incident side, and, in order that four rod electrodes among the N rod electrodes are in a quadrupole arrangement on an ion emission side, at least two rod electrodes of the four rod electrodes are tilted with respect to a central axis of the N-pole arrangement or the quadrupole arrangement so as to approach the central axis along the ion transport direction, and the voltage generation unit is configured to be able to apply radio-frequency voltages having phases inverted between adjacent rod electrodes of the N rod electrodes around an ion optical axis, to be able to apply a first DC voltage to the four rod electrodes in a quadrupole arrangement on the ion emission side, and to be able to apply a second DC voltage different from the first DC voltage to (N−4) rod electrodes other than the four rod electrodes among the N rod electrodes.

The mass spectrometer according to another aspect of the present invention made to solve the above problem is a mass spectrometer including an ion transport optical system configured to transport an ion to be analyzed.

The ion transport optical system includes

N rod electrodes, N being an even number of six or more, arranged to extend in an ion transport direction as a whole, and a voltage generation unit configured to apply predetermined voltages to the N rod electrodes respectively.

the N rod electrodes are in an N-pole arrangement on an ion incident side, and, in order that four rod electrodes among the N rod electrodes are in a quadrupole arrangement on an ion emission side, at least two rod electrodes of the four rod electrodes have a shape bent to approach a central axis of the N-pole arrangement or the quadrupole arrangement in at least a part of lengths of the at least two rod electrodes along the ion transport direction, and the voltage generation unit is configured to be able to apply radio-frequency voltages having phases inverted between adjacent rod electrodes of the N rod electrodes around an ion optical axis, to be able to apply a first DC voltage to the four rod electrodes in a quadrupole arrangement on the ion emission side, and to be able to apply a second DC voltage different from the first DC voltage to (N−4) rod electrodes other than the four rod electrodes among the N rod electrodes.

Advantageous Effects of Invention

In the ion transport optical system of the mass spectrometer according to the present invention, incident ions can be efficiently collected by high ion confinement action on the incident side of the ions, and the ions can be narrowed down to a small diameter and sent to the subsequent stage by the high ion convergence action on the ion emission side. In this manner, according to the mass spectrometer according to the present invention, it is possible to increase the amount of ions to be subjected to mass spectrometry by realizing high ion transport efficiency in the ion transport optical system. As a result, the analysis sensitivity can be improved.

Further, in the ion transport optical system of the mass spectrometer according to the present invention, electrode contamination that occurs in an ion funnel is unlikely to occur. For this reason, according to the mass spectrometer according to the present invention, it is possible to suppress deterioration in performance due to contamination of the electrodes of the ion transport optical system.

DESCRIPTION OF EMBODIMENTS

A mass spectrometer according to an embodiment of the present invention will be described with reference to the accompanying drawings.

Note that the drawings used in the description below are schematic, and the ratio of the dimensions of each constituent and the like do not reflect the actual device. Further, it is natural that a constituent unnecessary for the description is omitted as appropriate.

Configuration of the Device of the Present Embodiment

Figure 1:
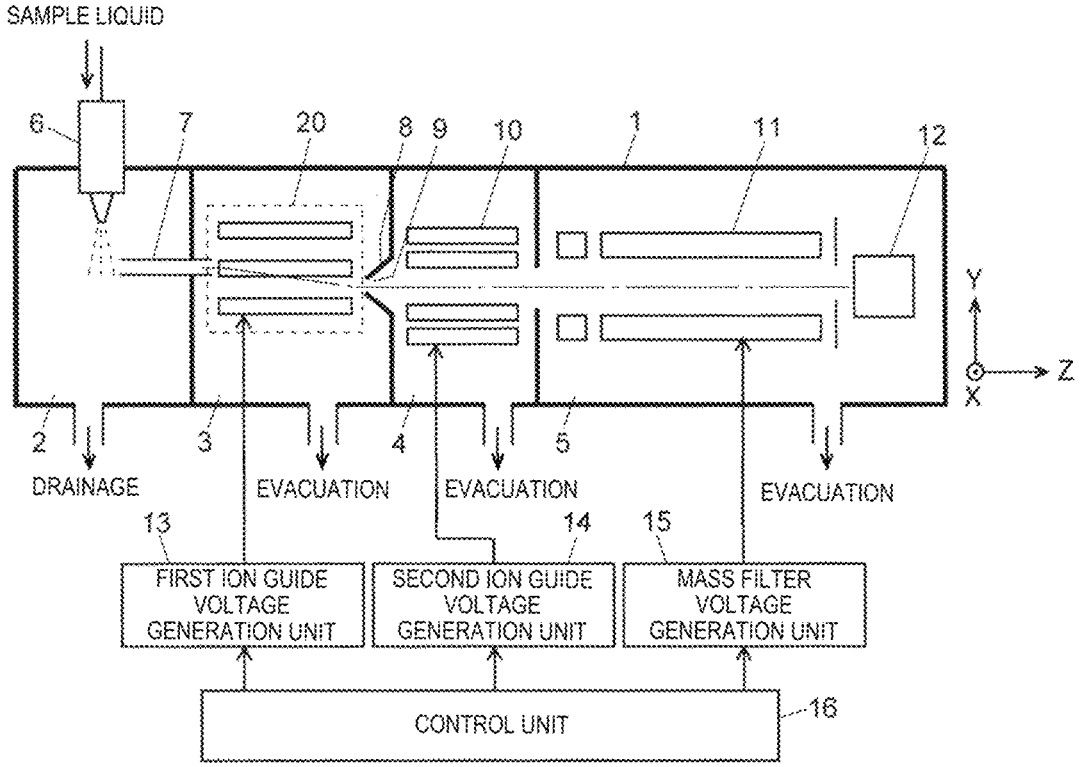
FIG. 1 is a schematic configuration diagram of a mass spectrometer according to an embodiment of the present invention.

FIG. 1 is a schematic configuration diagram of the mass spectrometer of the present embodiment. The mass spectrometer of the present embodiment is a single-type quadrupole mass spectrometer and has a multi-stage differential exhaust system configuration.

In a chamber 1 are arranged, an ionization chamber 2 which has a substantially atmospheric pressure atmosphere; a high vacuum chamber 5 having the highest degree of vacuum (that is, the gas pressure is the lowest); and a first intermediate vacuum chamber 3 and a second intermediate vacuum chamber 4 in which the degree of vacuum gradually increases between the ionization chamber 2 and the high vacuum chamber 5. Although now shown in FIG. 1, the inside of the first intermediate vacuum chamber 3 is evacuated by a rotary pump, and the inside of the second intermediate vacuum chamber 4 and the high vacuum chamber 5 is evacuated by a combination of the rotary pump and a turbo molecular pump.

The ionization chamber 2 is provided with an ESI spray 6 for performing electrospray ionization. The ionization chamber 2 and the first intermediate vacuum chamber 3 communicate with each other through a small-diameter heating capillary 7. A first ion guide 20 is provided in the first intermediate vacuum chamber 3, and a predetermined voltage is applied to the first ion guide 20 from a first ion guide voltage generation unit 13. The first intermediate vacuum chamber 3 and the second intermediate vacuum chamber 4 communicate with each other through an ion passage hole 9 formed at the top of a skimmer 8. A second ion guide 10 is provided in the second intermediate vacuum chamber 4, and a predetermined voltage is applied to the second ion guide 10 from a second ion guide voltage generation unit 14. A quadrupole mass filter 11 and an ion detector 12 are arranged in the high vacuum chamber 5. A predetermined voltage is applied to the quadrupole mass filter 11 from a mass filter voltage generation unit 15. The voltage generated by the first ion guide voltage generation unit 13, the second ion guide voltage generation unit 14, and the mass filter voltage generation unit 15 is controlled by a control unit 16.

Here, in order to facilitate understanding of the arrangement and a mutual positional relationship of elements arranged in the chamber 1, three axes of X, Y, and Z are defined as shown in FIG. 1. The Z-axis is the direction of the ion optical axis in almost the entire ion path except the inside of the first ion guide 20, and the X-axis and the Y-axis are axes in the directions orthogonal to each other and orthogonal to the Z-axis. The X-axis, Y-axis, and Z-axis do not necessarily indicate the directions such as top, bottom, right, and left of the device. However, here, for convenience of description, the Y-axis direction indicates the vertical direction of the device. Therefore, in the device of the present embodiment, the ESI spray 6 is configured to nebulize sample liquid downward. However, this is only an example and can be changed as appropriate.

Description of Schematic Operation in the Device of the Present Embodiment

The analysis operation in the mass spectrometer of the present embodiment is as described below.

Sample liquid containing a target component is supplied to the ESI Spray 6. The sample liquid is nebulized into a substantially atmospheric pressure atmosphere while being given a biased charge at the tip of the ESI spray 6. A nebulized sample droplet collides with the atmosphere and become finer, and ions derived from a sample component are generated in the process of evaporation of a solvent in the droplet. The various ions generated are sucked into the heating capillary 7 together with the atmosphere and the like and sent to the first intermediate vacuum chamber 3. The ions that enter the first intermediate vacuum chamber 3 are collected and converged by an electric field formed by the voltage applied from the first ion guide voltage generation unit 13 to the first ion guide 20. Then, the ions converged to a small diameter are sent to the second intermediate vacuum chamber 4 through the ion passage hole 9.

Note that the central axis of the outlet of the heating capillary 7 and the central axis of the ion passage hole 9 are not located on a straight line, and what is called an axis shift configuration is employed. This is for eliminating, in the first intermediate vacuum chamber 3, non-ionized sample component molecules and active neutral particles that are sent to the first intermediate vacuum chamber 3 together with the ions, so as to prevent them from being sent to the second intermediate vacuum chamber 4.

The ions that enter the second intermediate vacuum chamber 4 are collected and converged by an electric field formed by the voltage applied from the second ion guide voltage generation unit 14 to the second ion guide 10, and sent to the high vacuum chamber 5. Various ions derived from the sample that enter the high vacuum chamber 5 are introduced into the quadrupole mass filter 11. Of these various ions, only ions having a specific mass-to-charge ratio corresponding to the voltage applied from the mass filter voltage generation unit 15 to the quadrupole mass filter 11 pass through the quadrupole mass filter 11 and reach the ion detector 12. The ion detector 12 generates and outputs an ionic strength signal according to the number of reached ions. For example, the mass filter voltage generation unit 15 applies a voltage corresponding to the mass-to-charge ratio of ions of a target sample component to the quadrupole mass filter 11. In this manner, the influence of ions derived from impurities can be excluded, and a strength signal of ions of the target sample component can be obtained.

Detailed Configuration and Operation of the First Ion Guide 20

In the mass spectrometer of the present embodiment, the first ion guide 20 provided in the first intermediate vacuum chamber 3 guides ions sent into the first intermediate vacuum chamber 3 through the heating capillary 7 to the ion passage hole 9 of the skimmer 8 as described above. Next, the configuration and operation of the first ion guide 20 will be described in detail.

Figure 2:
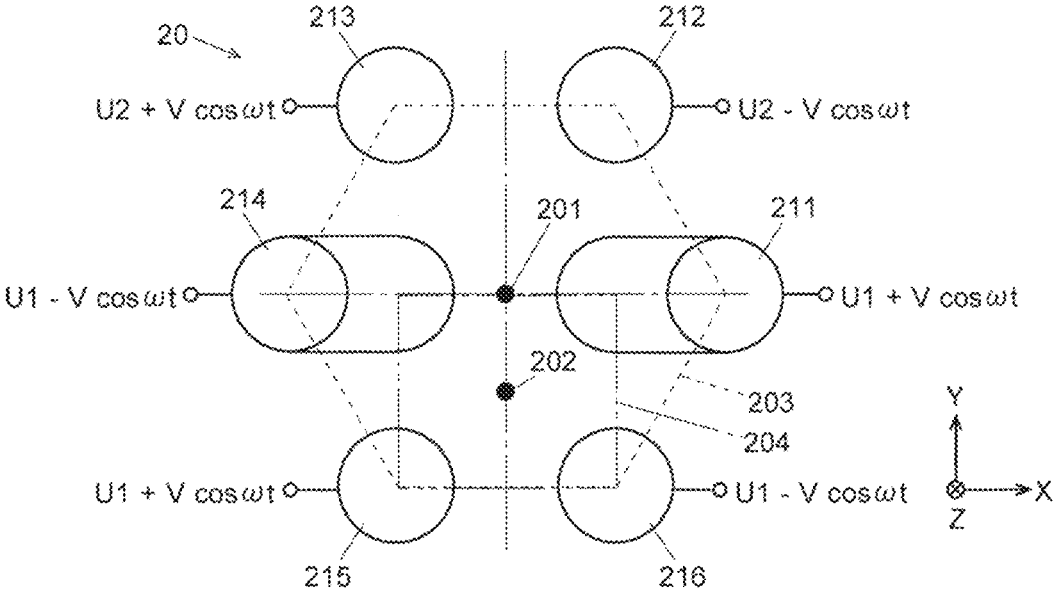
FIG. 2 is a plan view of a first ion guide in the mass spectrometer of the present embodiment as viewed from the ion incident side.
Figure 3:
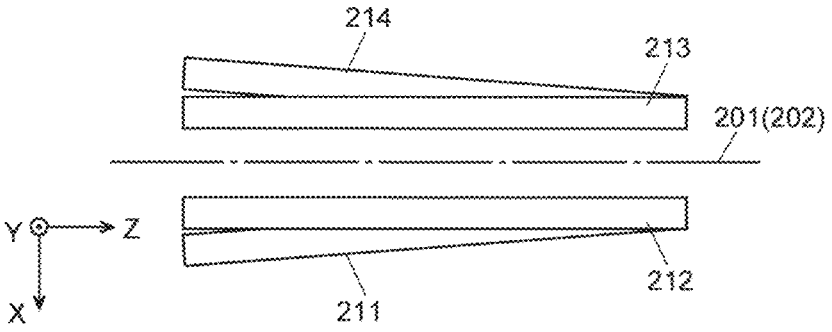
FIG. 3 is a plan view of the first ion guide in the mass spectrometer of the present embodiment as viewed from above.
Figure 4:
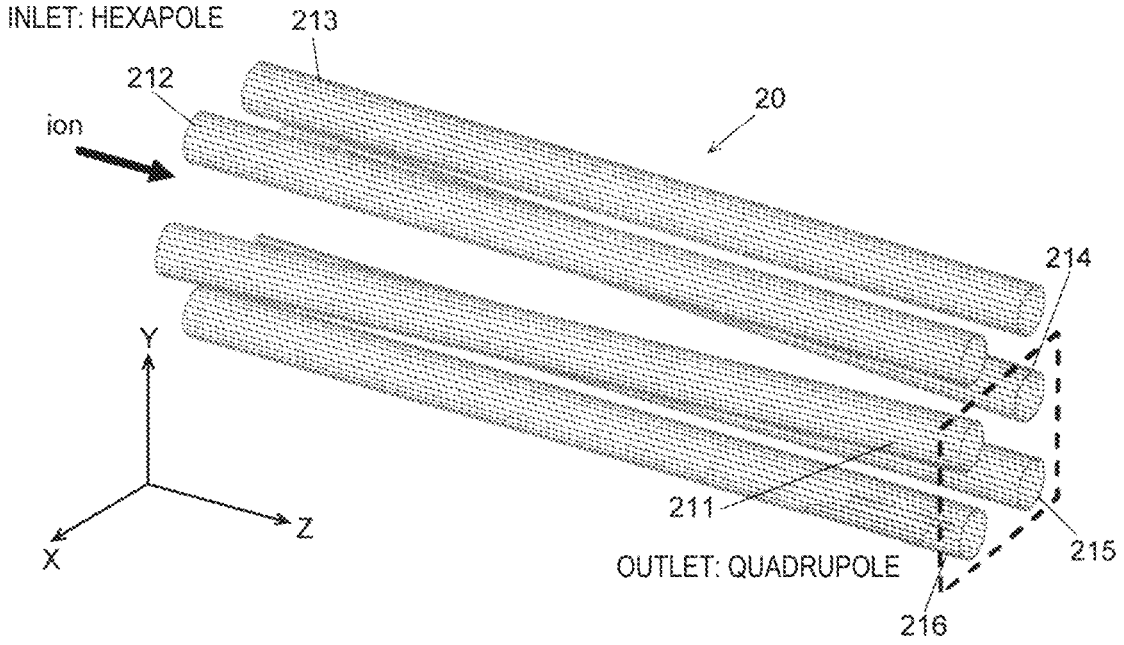
FIG. 4 is a perspective view of the first ion guide in the mass spectrometer of the present embodiment.

FIG. 2 is a plan view of the first ion guide 20 as viewed from the ion incident side. FIG. 3 is a plan view of the first ion guide 20 as viewed from above. FIG. 4 is a perspective view of the first ion guide 20.

The first ion guide 20 includes six rod electrodes 211 to 216 having an elongated cylindrical shape. As shown in FIG. 2, on an end face on the ion incident side (left side in FIG. 1), the six rod electrodes 211 to 216 are arranged at the positions of the apexes of a regular hexagon 203 having the center at a first central axis 201 parallel to the Z-axis. The four rod electrodes 212, 213, 215, and 216 among the six rod electrodes 211 to 216 are arranged parallel to the Z-axis. In contrast, the two rod electrodes 211 and 214 among the six rod electrodes 211 to 216 are non-parallel to the other four rod electrodes 212, 213, 215, and 216, that is, the Z-axis, and are tilted so as to approach the first central axis 201 along the ion transport direction (see FIG. 3).

Since the two rod electrodes 211 and 214 are tilted with respect to the Z-axis as described above, the four rod electrodes 211, 214, 215, and 216 are arranged at the positions of the apexes of a rectangle 204 having the center at a second central axis 202 parallel to the Z-axis on an end face on the ion emission side (right side in FIG. 1). The rectangle 204 is not strictly a square, and can be considered to be approximately a square. Therefore, the four rod electrodes 211, 214, 215, and 216 are substantially arranged as a quadrupole on the end face on the ion emission side.

That is, the six rod electrodes 211 to 216 in the first ion guide 20 have hexapole arrangement on the ion incident side and have quadrupole arrangement on the ion emission side. The first central axis 201, which is the center of the hexapole arrangement, and the second central axis 202, which is the center of the quadrupole arrangement, are parallel to each other but are not located on a straight line.

The voltage applied from the first ion guide voltage generation unit 13 to each of the rod electrodes 211 to 216 is as shown in FIG. 2. That is, a radio-frequency voltage $+V \cos \omega t$ or $-V \cos \omega t$ having the same amplitude whose phases are inverted to each other is applied between any of two adjacent rod electrodes around the first central axis 201. Therefore, $+V \cos \omega t$ and $-V \cos \omega t$ are alternately applied in the circumferential direction around the first central axis 201. Further, in addition to the radio-frequency voltage, a DC voltage U1 for efficiently transporting ions inside the first ion guide 20 is applied to the four rod electrodes 211, 214, 215, and 216. In contrast, to the other two rod electrodes 212 and 213, in a case where the polarity of ions to be analyzed is positive, a DC voltage U2 higher than the DC voltage U1 (larger on the positive electrode side) is applied, and in a case where the polarity of ions to be analyzed is negative, the DC voltage U2 lower than the DC voltage U1 (larger on the negative electrode side) is applied.

Note that, in general, the DC voltages U1 applied to the four rod electrodes 211, 214. 215, and 216 are the same, but do not need to be exactly the same. The above similarly applies to the DC voltage U2. Further, this also applies to variations described later.

Due to the radio-frequency voltage V cos ωt or −V cos ωt applied to each of the rod electrodes 211 to 216, a multipole radio-frequency electric field having the action of confining ions is formed in the space surrounded by the six rod electrodes 211 to 216. This multipole radio-frequency electric field, which is a hexapole radio-frequency electric field having the center at the first central axis 201 near the inlet of ions, is a quadrupole radio-frequency electric field having the center at the second central axis 202 near the outlet of ions. The state of the electric field gradually changes from the hexapole radio-frequency electric field to the quadrupole radio-frequency electric field between the inlet and the outlet of ions.

In contrast, due to a voltage difference between the DC voltage U1 and the DC voltage U2 applied to the six rod electrodes 211 to 216, an electric field that acts to press ions distributed around the first central axis 201 in the ion passage space toward the second central axis 202, that is, to deflect the orbit of the ions is formed. That is, one of the actions of the DC electric field formed by the DC voltage applied to the six rod electrodes 211 to 216 is the action of deflecting the ions during transportation.

Further, the DC potential on the first central axis 201 near the inlet of the space surrounded by the six rod electrodes 211 to 216 depends on the DC voltage U1 and the DC voltage U2, whereas the DC potential on the second central axis 202 near the outlet mainly depends only on the DC voltage U1. In a case where the polarity of the ions to be analyzed is positive, since the DC voltage U2 is higher than U1, the DC potential on the first central axis 201 near the inlet is higher than the DC potential on the second central axis 202 near the outlet. For this reason, the potential distribution on the optical axis of the ions transported in the space surrounded by the six rod electrodes 211 to 216 is considered to generally be the distribution of the downward gradient from the inlet to the outlet. Since this is, in other words, an accelerating electric field that accelerates positive ions, the ions that enter the space are provided with kinetic energy toward the outlet. That is, another action of the DC electric field formed by the DC voltage applied to the six rod electrodes 211 to 216 is the action of accelerating the ions during transportation.

In this manner, the ions that enter in the Z-axis direction in the space surrounded by the six rod electrodes 211 to 216 are collected by the hexapole radio-frequency electric field, and are deflected toward the rod electrodes 215 and 216 as a whole as they progress in the Z-axis direction. Further, since kinetic energy is provided when the ions progress, even in a case where the energy is lost due to contact with residual gas on the way, the ions progress smoothly toward the outlet without staying. Then, as the ions approach the outlet of the first ion guide 20, they are collected by the quadrupole radio-frequency electric field by the four rod electrodes 211, 214, 215, and 216 in the quadrupole arrangement, and are converged to the vicinity of the second central axis 202 and emitted as small-diameter ion flow. The central axis of the outlet of the heating capillary 7 that sends ions to the first ion guide 20 and the first central axis 201 substantially match with each other. Further, the central axis of the ion passage hole 9 that sends ions from the first ion guide 20 to the subsequent stage and the second central axis 202 substantially match with each other. Therefore, the first ion guide 20 is an axis-shifted ion optical system in which the incident axis and the exit axis of ions are in a state of being shifted from each other.

On the incident side of the ions of the first ion guide 20, the ions are collected by the hexapole radio-frequency electric field. Gas sent from the ionization chamber 2 which has a substantially atmospheric pressure atmosphere into the first intermediate vacuum chamber 3 becomes a supersonic free jet when discharged from the minute-diameter outlet of the heating capillary 7. For this reason, a barrel shock characteristic of a supersonic free jet occurs, and the ions on the gas spread greatly in the radial direction. In contrast, the hexapole radio-frequency electric field has a stronger ion confinement action (in other words, the ion acceptance is more excellent) than the quadrupole radio-frequency electric field. Accordingly, the ions in the spread state can be collected in an excellent manner and taken into the internal space. In this manner, it is possible to suppress the loss of ions on the incident side of the first ion guide 20 even when the ions are in the state of being spread in the radial direction.

As described above, the ions efficiently taken into the internal space converge to the vicinity of the second central axis 202 as they progress in the internal space of the first ion guide 20. The quadrupole radio-frequency electric field on the outlet side has a relatively low ion confinement action compared to the hexapole radio-frequency electric field on the inlet side, while having a strong action of converging the ions. For this reason, ions are converged in an excellent manner to the vicinity of the second central axis 202. Then, the ion flow narrowed down to a small diameter is emitted from the first ion guide 20, efficiently passes through the ion passage hole 9, and is sent to the second intermediate vacuum chamber 4. In this manner, it is possible to suppress the loss caused by the ions colliding with a wall surface around the ion passage hole 9 on the outlet side of the first ion guide 20.

Further, since the ions are provided with kinetic energy during transportation, it is possible to prevent the ions that have lost energy due to collision with the residual gas from being dissipated. In this manner, the passage efficiency of ions in the internal space of the first ion guide 20 is also excellent.

Furthermore, as described above, since the first ion guide 20 is an axis-shifted optical system, even in a case where neutral particles such as unionized sample molecules and active neutral particles are incident together with the ions, the neutral particles are not deflected and do not reach the ion passage hole 9. In this manner, it is possible to prevent the neutral particles from being sent to the subsequent stage.

Figure 5:
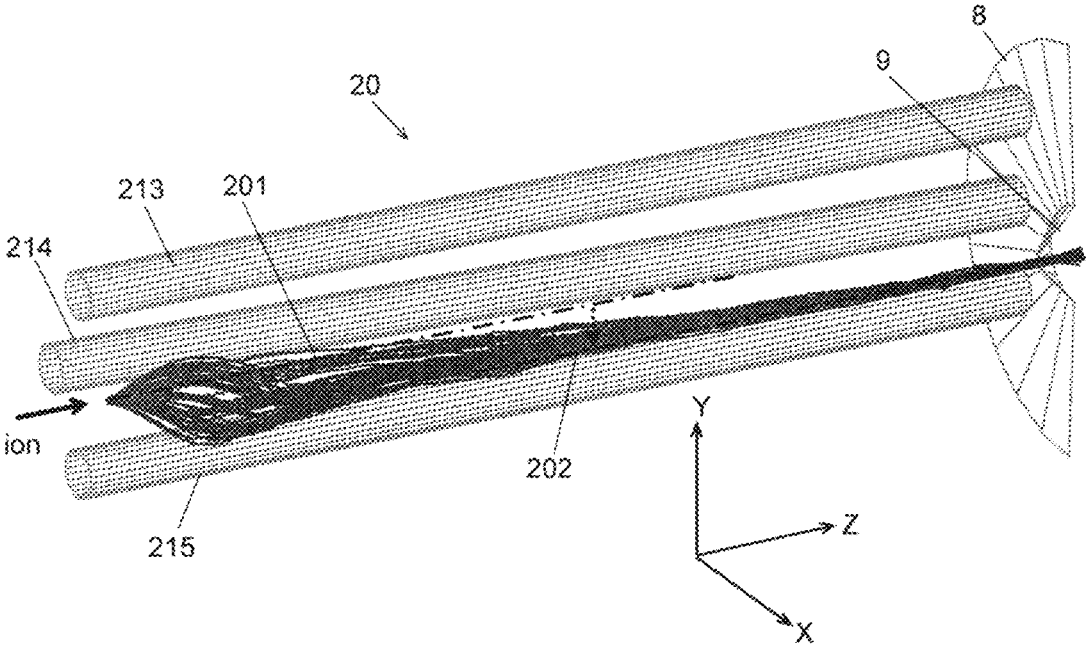
FIG. 5 is a diagram showing a result of simulating orbits of ions passing through the first ion guide in the mass spectrometer of the present embodiment.

FIG. 5 is a diagram showing a result of a computer simulation of the orbits of ions passing through the first ion guide 20. Here, the gas pressure is assumed to be 100 Pa. This gas pressure is a very general value as the gas pressure in an intermediate vacuum chamber adjacent to an ionization chamber, and it is known that the above-mentioned supersonic free jet is formed under the condition of this gas pressure. The simulation also considers the spread of ions due to this supersonic free jet. Note that, in FIG. 5, in order to make it easier to see the ion orbits, three of the rod electrodes 211, 212, and 216 located on the near side are not shown, and only three of the rod electrodes 213, 214, and 215 on the far side are shown.

As shown in FIG. 5, it can be seen that the ions that have spread and incident on the inlet side of the first ion guide 20 are collected in an excellent manner and guided to the internal space. Further, it can also be seen that the ions are transported while being gradually deflected downward, sufficiently converged near the outlet, and emitted as small-diameter ion flow. As described above, it can be understood from the simulation result that the first ion guide 20 in the mass spectrometer of the present embodiment transports ions efficiently, that is, with a small loss. As a result, more ions are introduced into the quadrupole mass filter 11, and high analytical sensitivity can be realized.

Note that, as described above, the rectangle 204 in which the four rod electrodes 211, 214, 215, and 216 are arranged on the end face on the ion emission side is not strictly a square. However, the four rod electrodes 211, 214, 215 and 216 may be arranged at the apex positions of the square on the end face on the ion emission side in a manner that the two rod electrodes 215 and 216 are also tilted slightly with respect to the Z-axis and a tilt amount of the two rod electrodes 211 and 214 is increased slightly. According to such a configuration, the convergence of ions near the outlet of the first ion guide 20 becomes further excellent. Further, for the purpose of adjusting an axis shift amount, adjustments, such as tilting the outlet sides of the four rod electrodes 211, 214, 215, and 216 in the −Y-axis direction (downward direction in FIG. 2) so that the second central axis 202 is further separated from the first central axis 201, are also possible.

The first ion guide 20 in the above embodiment includes six rod electrodes and has hexapole arrangement on the ion incident side. However, the number of rod electrodes may be an even number of six or more. As the number of rod electrodes increases, the ion confinement ability at the inlet of the ion guide improves. However, even if the number of rod electrodes is increased to a certain extent or more, the degree of improvement in the confinement ability is slight. Further, as the number of rod electrodes increases, the structure of the ion guide becomes more complicated, and the assemblability and maintainability deteriorate. Considering these facts, practically, the number of rod electrodes is preferably about six, eight, ten, or twelve. As a variation, a case where the number of rod electrodes is set to eight and a case where the number of rod electrodes is set to twelve will be described below.

First Variation of the Ion Guide

Figure 6:
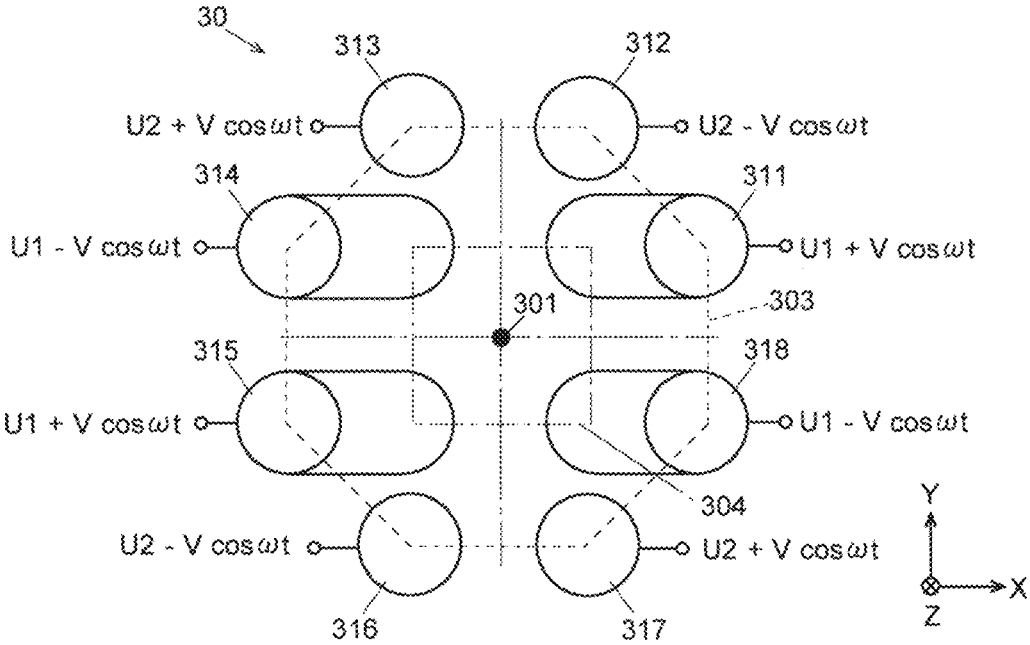
FIG. 6 is a plan view of the ion guide, which is a first variation, as viewed from the ion incident side.
Figure 7:
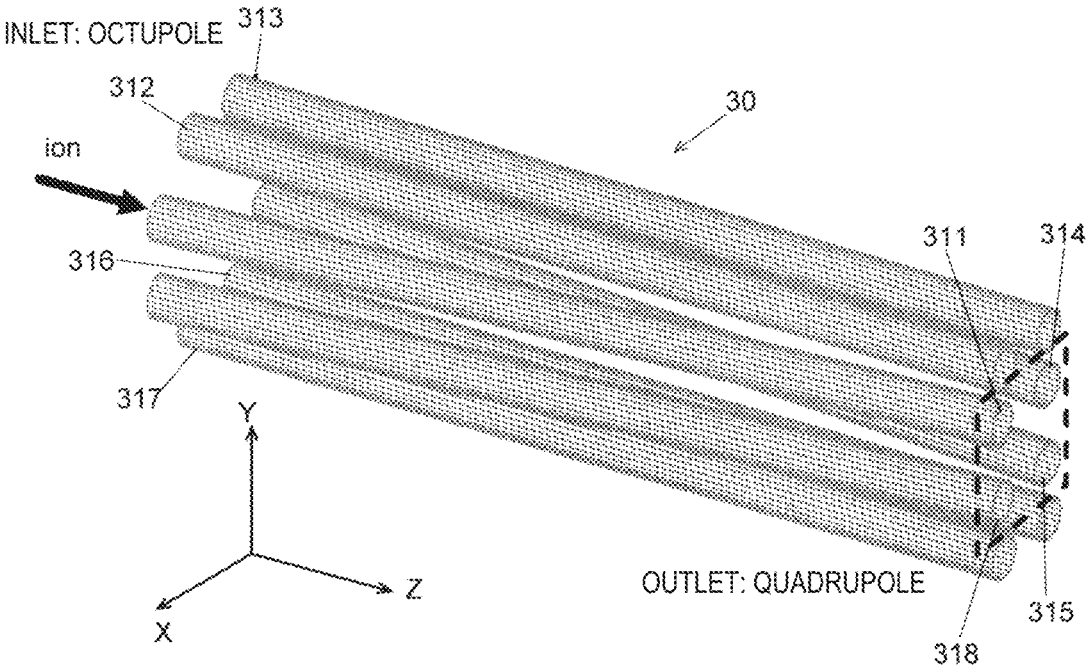
FIG. 7 is a perspective view of the ion guide which is the first variation.

FIG. 6 is a plan view of an ion guide 30, which is a first variation, as viewed from the ion incident side. Further, FIG. 7 is a perspective view of the ion guide 30.

The ion guide 30 includes eight rod electrodes 311 to 318 having an elongated cylindrical shape. As shown in FIG. 6, on the end face on the incident side of ions, the eight rod electrodes 311 to 318 are arranged at the positions of the apexes of a regular octagon 303 having the center at a central axis (ion optical axis) 301. The four rod electrodes 312, 313, 316, and 317 among the eight rod electrodes 311 to 318 are arranged parallel to the Z-axis. In contrast, the other four rod electrodes 311, 314, 315, and 318 among the eight rod electrodes 311 to 318 are non-parallel to the Z-axis, and all of the four rod electrodes 311, 314, 315, and 318 are arranged on the X-Z plane and to be tilted so as to approach the Y-axis passing through the central axis 301 (as a whole, approach the central axis 301) along as the ion transport direction.

As described above, the four rod electrodes 311, 314, 315, 318 are tilted with respect to the Z-axis. In this manner, the four rod electrodes 311, 314, 315, and 318, are arranged at the apex positions of a rectangle 304 having the center at the central axis 301 on the end face on the ion emission side, and the other rod electrodes are located outside the space surrounded by the four rod electrodes 311, 314, 315, and 318. In this case, the rectangle 304 is a square. Therefore, the eight rod electrodes 311 to 318 in the ion guide 30 are in an octupole arrangement on the ion incident side and a quadrupole arrangement on the ion emission side.

In this case, unlike the configuration of the first ion guide 20 in the above embodiment, the central axis 301 is the same in the octupole arrangement and the quadrupole arrangement, and it is not an axis-shifted optical system. Therefore, when this ion guide 30 is used instead of the first ion guide 20 in FIG. 1, the position of the heating capillary 7 or the skimmer 8 is changed so that the central axis of the outlet of the heating capillary 7 and the central axis of the ion passage hole 9 of the skimmer 8 are located on a straight line. Note that this similarly applies to a case where the ion guide according to a second variation described later is used.

The voltage applied to each of the rot electrodes 311 to 318 is as described in FIG. 6, and the radio-frequency voltage $+V \cos \omega t$ or $-V \cos \omega t$ having the same amplitude whose phases are inverted to each other is applied between two adjacent rod electrodes around the central axis 301. Further, in addition to the radio-frequency voltage, the DC voltage U1 for efficiently transporting ions inside the ion guide 30 is applied to the four rod electrodes 311, 314, 315, and 318 that form a quadrupole on the ion emission side. In contrast, to the four rod electrodes 312, 313, 316, and 317 other than the above, in a case where the polarity of ions to be analyzed is positive, the DC voltage U2 higher than the DC voltage U1 is applied, and in a case where the polarity of ions to be analyzed is negative, the DC voltage U2 lower than the DC voltage U1 is applied.

In this manner, an octupole radio-frequency electric field with a strong ion confinement action is formed at the inlet of the ion guide 30, and the ions introduced into the first intermediate vacuum chamber are efficiently collected and taken into the internal space of the ion guide 30. The taken-in ions are gradually pushed into the space surrounded by the other four rod electrodes 311, 314, 315, and 318 by a DC electric field formed mainly by the DC voltage applied to the four rod electrodes 312, 313, 316, and 317. In this case, since the ion optical axes are on a straight line on the inlet side and the outlet side, the electric field that deflects ions substantially does not act. However, an action as an accelerating electric field that accelerates (provides kinetic energy to) ions toward the outlet is provided. Then, as the ions approach the outlet, they are converged to the vicinity of the central axis 301 by the quadrupole radio-frequency electric field formed in the space surrounded by the four rod electrodes 311, 314, 315, and 318, and become a small-diameter ion flow to be emitted.

In this way, excellent ion transport efficiency can be achieved even with the ion guide 30.

Note that, in a case where it is not necessary to deflect ions during transportation as in the first variation and the second variation, the DC voltage U2 does not have to be higher than the DC voltage U1 (in a case where the ions are positive). In a case where the ions to be analyzed are positive and the DC voltage U2 is lower than the DC voltage U1, the DC potential on the central axis near the inlet of the ion guide is lower than the DC potential on the central axis near the outlet as clear from the above description. That is, considering the potential distribution on the optical axis of the ions transported in the space surrounded by a plurality of rod electrodes, the distribution of the upward gradient from the inlet to the outlet is generally obtained. Since this is a decelerating electric field that decelerates positive ions, the ions that enter the space are gradually deprived of kinetic energy as they move toward the outlet. That is, the action of the DC electric field formed by the DC voltage applied to a plurality of rod electrodes is the action of decelerating the ions during transportation.

For example, in the configuration of the mass spectrometer shown in FIG. 1, in a case where a flow velocity of air flowing from the ionization chamber 2 into the first intermediate vacuum chamber 3 is large due to a pressure difference between both ends of the heating capillary 7, the opening diameter of the heating capillary 7, and the like, ions introduced into the first intermediate vacuum chamber 3 may have too large initial kinetic energy to be collected by the radio-frequency electric field. In such a case, instead of forming an accelerating electric field toward the outlet in the internal space of the ion guide, a decelerating electric field is formed, and the kinetic energy of the ions is actively reduced by the action of this deceleration electric field. In this manner, the ions can be collected by the radio-frequency electric field in an excellent manner and guided to the outlet while being converged.

As described above, the magnitude relationship between the DC voltage U1 and the DC voltage U2 can be appropriately changed depending on how the ions incident on the ion guide are to be controlled.

Second Variation of the Ion Guide

Figure 8:
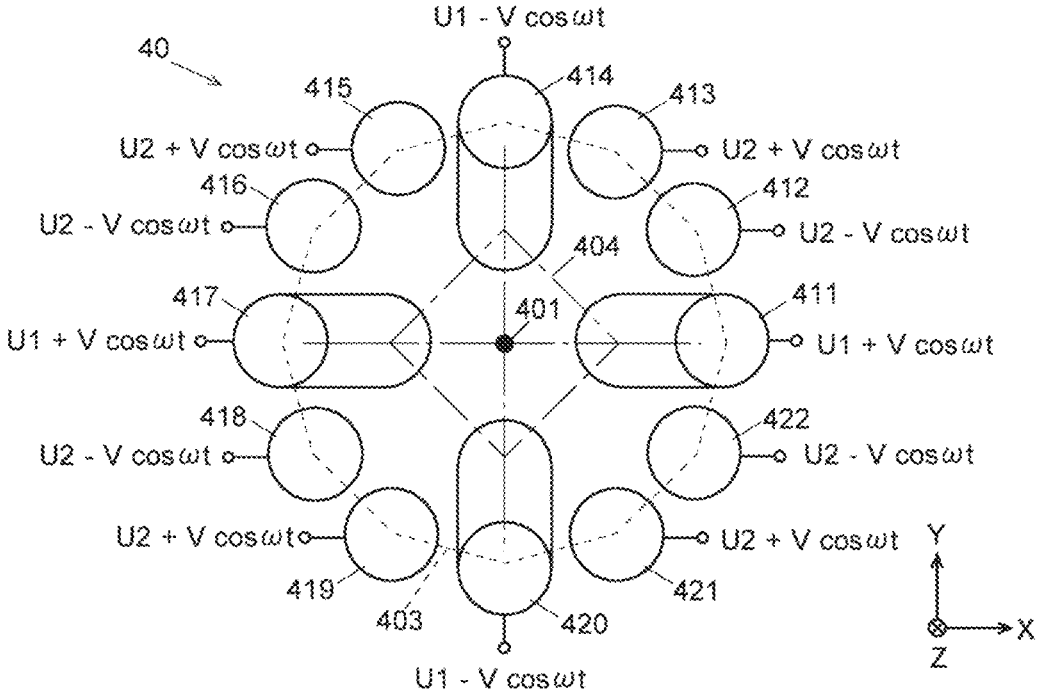
FIG. 8 is a plan view of the ion guide, which is a second variation, as viewed from the ion incident side.
Figure 9:
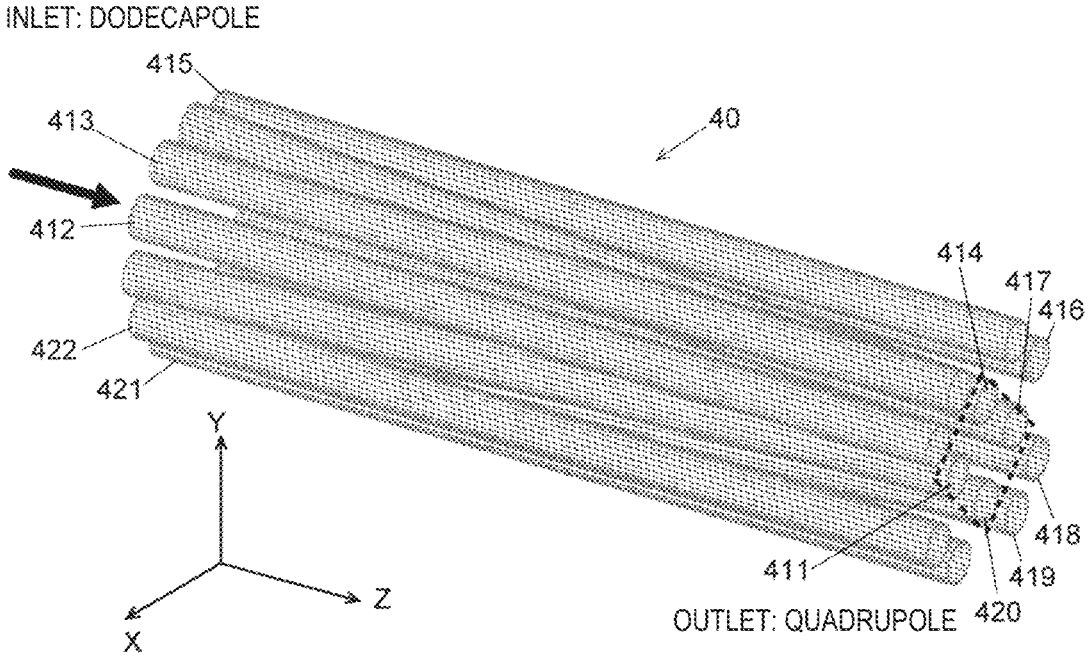
FIG. 9 is a perspective view of the ion guide which is the second variation.
Figure 10:
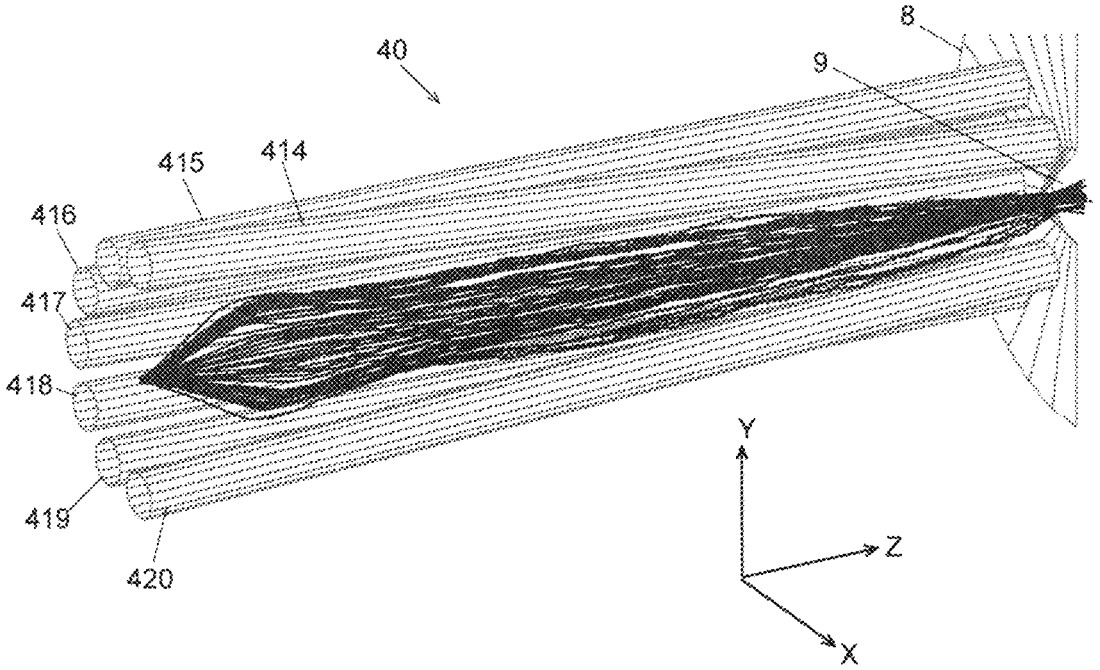
FIG. 10 is a diagram showing a result of simulating orbits of ions passing through the ion guide, which is the second variation.

FIG. 8 is a plan view of an ion guide 40, which is the second variation, as viewed from the ion incident side. Further, FIG. 9 is a perspective view of the ion guide 40. Further, FIG. 10 is a diagram showing a result of a computer simulation of the orbits of ions passing through the ion guide 40.

The ion guide 40 includes twelve rod electrodes 411 to 422, which have an elongated cylindrical shape. As shown in FIG. 8, on the end face on the incident side of ions, the twelve rod electrodes 411 to 422 are arranged at the positions of the apexes of a regular dodecagon 403 having the center at a central axis (ion optical axis) 401. The eight rod electrodes 412, 413, 415, 416, 418, 419, 421, and 422 among the twelve rod electrodes 411 to 422 are arranged parallel to the Z-axis. In contrast, the other four rod electrodes 411, 414, 417, and 420 among the twelve rod electrodes 411 to 422 are non-parallel to the Z-axis, and all of the four rod electrodes 411, 414, 417, and 420 are tilted so as to approach the central axis 401 along the ion transport direction.

As described above, the four rod electrodes 411, 414, 417, and 420 are tilted with respect to the Z-axis. In this manner, the four rod electrodes 411, 414, 417, and 420 are arranged at the apex positions of a square 404 having the center at the central axis 401 on the end face on the ion emission side, and the other rod electrodes are located outside the space surrounded by the four rod electrodes 411, 414, 417, and 420. Therefore, the twelve rod electrodes 411 to 422 in the ion guide 40 are in a dodecapole arrangement on the ion incident side and a quadrupole arrangement on the ion emission side In this case as well, it is not an axis-shifted optical system.

The voltage applied to each of the rot electrodes 411 to 422 is as described in FIG. 8, and the radio-frequency voltage $+V \cos \omega t$ or $-V \cos \omega t$ having the same amplitude whose phases are inverted to each other is applied between two adjacent rod electrodes around the central axis 401. Further, in addition to the radio-frequency voltage, the DC voltage U1 for efficiently transporting ions inside the ion guide 40 is applied to the four rod electrodes 411, 414, 417, and 420 that form a quadrupole on the ion emission side. In contrast, to the eight rod electrodes 412, 413, 415, 416, 418, 419, 421, and 422 other than the above, in a case where the polarity of ions to be analyzed is positive, the DC voltage U2 higher than the DC voltage U1 is applied, and in a case where the polarity of ions to be analyzed is negative, the DC voltage U2 lower than the DC voltage U1 is applied.

In this manner, a dodecapole radio-frequency electric field with a stronger ion confinement action than an octupole radio-frequency electric field is formed at the inlet of the ion guide 40, and the ions introduced into the first intermediate vacuum chamber are efficiently collected and taken into the internal space of the ion guide 40. The taken-in ions are gradually pushed into the space surrounded by the other four rod electrodes 411, 414, 417, and 420 by a DC electric field formed mainly by the DC voltage applied to the eight rod electrodes 412, 413, 415, 416, 418, 419, 421, and 422. In this case as well, since the ion optical axes are on a straight line on the inlet side and the outlet side, the DC electric field in the ion passage space does not have the action of deflecting ions. However, the DC electric field has the action of accelerating ions toward the outlet (providing kinetic energy). Then, as the ions approach the outlet, they are converged to the vicinity of the central axis 401 by the quadrupole radio-frequency electric field formed in the space surrounded by the four rod electrodes 411, 414, 417, and 420, and become a small-diameter ion flow to be emitted.

From a simulation result of the ion orbits shown in FIG. 10 as well, it can be seen that the ions that have spread and incident on the inlet side of the ion guide 40 are collected in an excellent manner and guided to the internal space. Further, it can also be seen that the ions are converged to the vicinity of the central axis 401 as they progress, and are sufficiently converged near the outlet and emitted as small-diameter ion flow. As described above, excellent ion transport efficiency can be achieved even with the ion guide 40.

Another Variation of the Ion Guide

In the above embodiment and variations, the lengths of the six, eight, or twelve rod electrodes included in the first ion guide 20 or the ion guides 30 and 40 are substantially the same. However, other rod electrodes other than the four rod electrodes in a quadrupole arrangement on the end face on the ion emission side, for example, the two rod electrodes 212 and 213 in the first ion guide 20 shown in FIGS. 2 to 4, do not need to extend to the ion emitting end face. This is because the rod electrodes 212 and 213 do not contribute to the formation of a quadrupole radio-frequency electric field near the ion outlet, and the action of ion deflection by the DC electric field is unnecessary near the ion outlet. From the above point of view, the other rod electrodes except the four rod electrodes in a quadrupole arrangement on the end face on the ion emission side only need to exist in a region where ions which are initially spread in a relatively wide internal space reliably enter the space surrounded by the four rod electrodes in a quadrupole arrangement.

Figure 11:
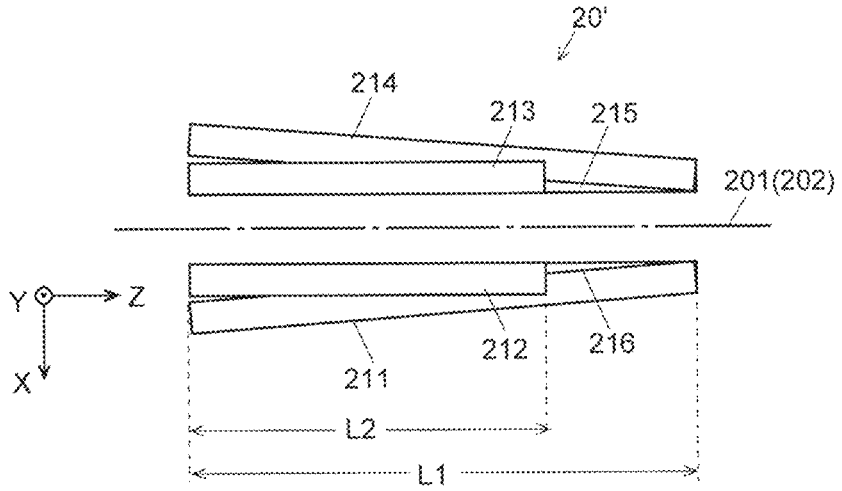
FIG. 11 is a plan view of the ion guide, which is still another variation, as viewed from above.

FIG. 11 is a plan view of the ion guide, which is an example of a configuration in which a part of the rod electrode is shorter than the other rod electrodes, as seen from above. As clear from comparison with FIG. 3, in this example, of the six rod electrodes 211 to 216, the length of the two rod electrodes 212 and 213 is L2, which is shorter than a length L1 of the other four rod electrodes 211, 214, 215, and 216. When the ions incident on the ion guide 20 are sufficiently deflected during the length L2 and enter the radio-frequency electric field formed by the four rod electrodes 211, 214, 215, and 216, an effect substantially similar to the case where the lengths of the two rod electrodes 212 and 213 are L1 can be obtained. This similarly applies to a case where the number of rod electrodes is other than six.

Figure 12:
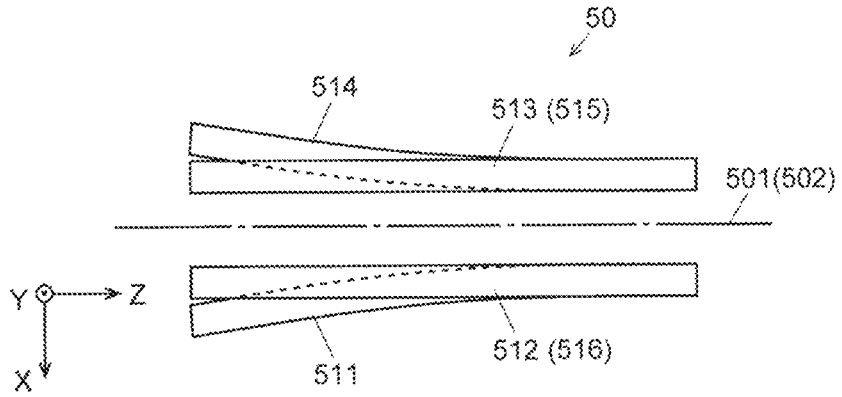
FIG. 12 is a plan view of the ion guide, which is still another variation, as viewed from above.

Further, in the above embodiment and variations, the rod electrodes included in the ion guides 20, 30, and 40 are linear, and some of the rod electrodes are tilted with respect to the Z-axis. However, it is also possible to use a rod electrode that is not linear and has a shape bent at least partly in the extending direction of the rod electrode. FIG. 12 is a plan view of an ion guide 50, which is a variation, using a bent-shaped rod electrode as viewed from above.

As clear from comparison with FIG. 3, in this example, of six rod electrodes 511 to 516, the two rod electrodes 511 and 514 have a bent shape. Even with such a configuration, a hexapole arrangement can be realized at the inlet of the ion guide 50 and a quadrupole arrangement can be realized at the outlet. Therefore, as to the ion transport efficiency, an effect almost equivalent to that of the ion guide in the above embodiment can be obtained. Note that the bent shape referred to here is not limited to one in which a part of the rod electrode in the extending direction is curved, and includes, for example, a shape in which a part of the rod electrode in the extending direction (not limited to one location) is folded at a predetermined angle.

Further, in the description of the above-described embodiment and variations, the polarity of the ions to be analyzed is positive. However, it is clear that a case where the polarity of the ions to be analyzed is negative can be supported when the DC voltage applied to each rod electrode included in the ion guide or the DC voltage applied to the other units is appropriately changed.

Mass Spectrometer of Other Embodiments

In the mass spectrometer of the above embodiment, the first ion guide 20 is provided in the first intermediate vacuum chamber 3. However, the configuration may be such that the first ion guide 20 and the ion guides of the above variations are arranged in the second intermediate vacuum chamber 4 having a low gas pressure as compared with the first intermediate vacuum chamber 3 and a high gas pressure as compared to the high vacuum chamber 5. That is, as the second ion guide 10 in FIG. 1, the first ion guide 20 or the ion guide of each of the above variations may be used.

Further, the configuration may be such that, instead of a single type quadrupole mass spectrometer, in a mass spectrometer, such as a triple quadrupole mass spectrometer, a quadrupole time-of-flight mass spectrometer, a Fourier transform ion cyclotron resonance mass spectrometer, or the like, that performs ionization under atmosphere or gas pressure close to the atmosphere and transports ions through one or a plurality of intermediate vacuum chambers to a mass separator arranged in a high vacuum, the first ion guide 20 or the ion guide of each of the above variations is provided inside the intermediate vacuum chambers. Further, the ion source is not limited to an ESI ion source, and can be replaced with an ion source by various ionization method, such as the atmospheric pressure chemical ionization (APCI) method, the atmospheric pressure photoionization (APPI) method, the probe electrospray ionization (PESI) method, and the direct analysis in real time (DART) method. That is, the ion source and the mass separator are not limited to those described above, and those of various types or methods can be used.

Further, instead of arranging the first ion guide 20 or the ion guide of each of the above variations inside the intermediate vacuum chamber, the configuration may be such that the first ion guide 20 or the ion guide of each of the variations is provided inside the cell, into which various types of gas such as collision gas and reaction gas are introduced from the outside, that performs various operations on ions by using the gas.

Specifically, for example, a triple quadrupole mass spectrometer or a quadrupole time-of-flight mass spectrometer includes a collision cell that dissociates ions by collision induced dissociation (CID). The first ion guide 20 or the ion guide of each of the above variations may be provided inside the collision cell. Further, an inductively coupled plasma (ICP) mass spectrometer generally includes a collision cell or a reaction cell to eliminate interfering ions or molecules. The configuration may be such that the first ion guide 20 or the ion guide of each of the above variations is configured to be provided inside the collision cell or reaction cell.

Further, the above-described embodiment and variations are merely examples of the present invention, and it is natural that variations, additions, and modifications appropriately made within the scope of the present invention are included in the scope of claims.

Various embodiments of the present invention are described above with reference to the drawings. Finally, various aspects of the present invention will be described.

The mass spectrometer according to a first aspect of the present invention is a mass spectrometer including an ion transport optical system configured to transport ions to be analyzed.

The ion transport optical systems (20 and 13) include

N rod electrodes (211 to 216), N being an even number of six or more, arranged to extend in an ion transport direction as a whole, and a voltage generation unit (13) configured to apply predetermined voltages to the N rod electrodes (211 to 216) respectively, the N rod electrodes (211 to 216) are in an N-pole arrangement on an ion incident side, and, in order that four rod electrodes (211, 214, 215, and 216) of the N rod electrodes (211 to 216) are in a quadrupole arrangement on an ion emission side, at least two rod electrodes (211 and 214) of the four rod electrodes (211, 214, 215, and 216) are tilted with respect to central axes (201 and 202) of the N-pole arrangement or the quadrupole arrangement so as to approach the central axes (201 and 202) as the rod electrodes progress in the ion transport direction, and the voltage generation unit (13) is configured to be able to apply radio-frequency voltages having phases inverted to each other between adjacent rod electrodes of the N rod electrodes (211 to 216) around an ion optical axis, apply a first DC voltage to the four rod electrodes (211, 214, 215, and 216) in a quadrupole arrangement on the ion emission side, and apply a second DC voltage different from the first DC voltage to (N−4) rod electrodes (212 and 213) other than the four rod electrodes among the N rod electrodes (211 to 216).

According to the mass spectrometer of the first aspect, on the ion incident side of the ion transport optical system, the ion convergence action is relatively weak while the ion confinement action is strong, so that the introduced ions can be collected with a small loss. In contrast, on the ion emission side of the ion transport optical system, the ion confinement action is relatively weak while ion convergence action is strong, so that the ions can be narrowed down to a small diameter and sent out. In this manner, even in a case where ions are introduced while expanding due to, for example, a supersonic free jet, the ions can be efficiently collected and transported to the subsequent stage through a small-diameter ion passage hole. As a result, the amount of ions used for mass spectrometry can be increased and the analysis sensitivity can be improved.

Further, the mass spectrometer according to a second aspect of the present invention is a mass spectrometer including:

an ion transport optical system configured to transport an ion to be analyzed.

The ion transport optical system (50 and 13) includes

N rod electrodes (511 to 516), N being an even number of six or more, arranged to extend in an ion transport direction as a whole, and a voltage generation unit (13) configured to apply predetermined voltages to the N rod electrodes respectively, the N rod electrodes (511 to 516) are in an N-pole arrangement on an ion incident side, and, in order that four rod electrodes (511, 514, 515, and 516) of the N rod electrodes (511 to 516) are in a quadrupole arrangement on an ion emission side, at least two rod electrodes (511 and 514) of the four rod electrodes (511, 514, 515, and 516) have a shape bent to approach a central axis (501 and 502) of the N-pole arrangement or the quadrupole arrangement in at least a part of lengths of the at least two rod electrodes along the ion transport direction, and the voltage generation unit is configured to be able to apply radio-frequency voltages having phases inverted to each other between adjacent rod electrodes of the N rod electrodes (511 to 516) around an ion optical axis, apply a first DC voltage to the four rod electrodes (511, 514, 515, and 516) in a quadrupole arrangement on the ion emission side, and apply a second DC voltage different from the first DC voltage to (N−4) rod electrodes (512 and 513) other than the four rod electrodes among the N rod electrodes (511 to 516).

According to the mass spectrometer of the second aspect, an effect similar to that of the mass spectrometer of the first aspect is obtained. That is, even in a case where ions are introduced w % bile expanding due to, for example, a supersonic free jet, the ions can be efficiently collected and transported to the subsequent stage through a small-diameter ion passage hole. In this manner, the amount of ions used for mass spectrometry can be increased and the analysis sensitivity can be improved.

The mass spectrometer of a third aspect of the present invention is the mass spectrometer according to the first or second aspect, in which the voltage generation unit (13) applies the second DC voltage, which has a voltage value larger than that of the first DC voltage, to the (N−4) rod electrodes.

According to the mass spectrometer of the third aspect, for example, for positive ions, the DC potential on the central axis of the space near the ion inlet surrounded by the N rod electrodes is higher than the DC potential on the central axis of the space near the ion outlet surrounded by four of the rod electrodes. That is, in the space surrounded by the rod electrodes, a downward-gradient potential distribution is formed from the inlet side to the outlet side of ions, so that the ions are accelerated. In this manner, even in a case where ions lose their kinetic energy due to collision with residual gas or the like, the ions can be provided with kinetic energy and smoothly guided to the outlet, and the ion transport efficiency can be improved.

The mass spectrometer of a fourth aspect of the present invention is the mass spectrometer according to the third aspect, in which a central axis of the N-pole arrangement and a central axis of the quadrupole arrangement are parallel and not located on a straight line, and the ion transport optical system deflects an ion in a direction orthogonal to the two central axes on a way by a difference between the first DC voltage and the second DC voltage.

According to the mass spectrometer of the fourth aspect, not only ions can be efficiently transported, but also the ion optical axis can be shifted by the action of an electric field during the transportation. In this manner, neutral particles such as a sample component molecule and an active neutral particle that enter the space surrounded by the rod electrode together with the ions are separated from the ions while being transported in the space, and only ions from which such neutral particles are removed are emitted from the outlet. As a result, it is possible to reduce the neutral particles sent to the subsequent stage together with the ions.

The mass spectrometer of a fifth aspect of the present invention is the mass spectrometer according to the first or the second aspect, in which a central axis (301) of the N-pole arrangement and a central axis (301) of the quadrupole arrangement are located on a straight line.

According to the mass spectrometer of the fifth aspect, the central axis of the N-pole arrangement on the ion incident side and the central axis of the quadrupole arrangement on the ion emission side in the ion transport optical system are on a straight line. Accordingly, the loss of ions when passing through the ion transport optical system is small, and the incident ions can be efficiently converged and emitted.

The mass spectrometer of a sixth aspect of the present invention is the mass spectrometer according to the first or second aspect, in which the N is an even number in a range of six to twelve.

According to the mass spectrometer of the sixth aspect, it is possible to realize a practically sufficiently high ion transport efficiency while avoiding the configuration of the rod electrode of the ion transport optical system from becoming too complicated.

The mass spectrometer of a seventh aspect of the present invention is the mass spectrometer according to the sixth aspect, further including one or more intermediate vacuum chambers (3 and 4) between an ionization chamber (2) that ionizes a sample component in an atmospheric pressure atmosphere and a high vacuum chamber (5) in which a mass separation unit (11) is provided and a high vacuum is maintained, in which the N rod electrodes (211 to 216) are arranged in an intermediate vacuum chamber (3) on a next stage of the ionization chamber (2).

According to the mass spectrometer of the seventh aspect, ions derived from a sample component generated in the ionization chamber and sent to the intermediate vacuum chamber of the subsequent stage can be transported to a next intermediate vacuum chamber or a high vacuum chamber efficiently, that is, while the loss of ions is suppressed. In this manner, the amount of ions used for mass spectrometry can be increased and high analysis sensitivity can be realized.

The mass spectrometer of an eighth aspect of the present invention is the mass spectrometer according to the sixth aspect, further including two or more intermediate vacuum chambers (3 and 4) between an ionization chamber (2) that ionizes a sample component in an atmospheric pressure atmosphere and a high vacuum chamber (5) in which a mass separation unit (11) is provided and a high vacuum is maintained, in which the N rod electrodes (211 to 216) are arranged in an intermediate vacuum chamber (4) on a stage subsequent to a next stage of the ionization chamber (2).

According to the mass spectrometer of the eighth aspect, ions derived from a sample component sent from the intermediate vacuum chamber of a previous stage to the intermediate vacuum chamber of the subsequent stage can be transported to a next intermediate vacuum chamber or a high vacuum chamber efficiently, that is, while the loss of ions is suppressed. In this manner, the amount of ions used for mass spectrometry can be increased and high analysis sensitivity can be realized.

The mass spectrometer of a ninth aspect of the present invention is the mass spectrometer according to the sixth aspect, further including a collision cell configured to dissociate ions by making the ions in contact with predetermined gas, in which the N rod electrodes are arranged in the collision cell.

According to the mass spectrometer of the ninth aspect, it is possible to efficiently dissociate ions introduced into the collision cell while the loss of the ions is suppressed. Further, product ions and the like generated by the dissociation of the ions can be discharged from the collision cell efficiently, that is, while the loss of the ions is suppressed, and transported to, for example, the mass separator in the subsequent stage. In this manner, it is possible to increase the amount of ions to be subjected to mass spectrometry in a triple quadrupole mass spectrometer or a quadrupole time-of-flight mass spectrometer, and to realize high analysis sensitivity.

The mass spectrometer of a tenth aspect of the present invention is the mass spectrometer according to the sixth aspect, further including a reaction cell configured to cause ions to react with predetermined gas, in which the N rod electrodes are arranged in the reaction cell.

According to the mass spectrometer of the tenth aspect, it is possible to efficiently cause undesired neutral particles and the like introduced together with ions to be analyzed to react with the gas while the loss of the ions introduced into the reaction cell is suppressed. In this manner, in an ICP mass spectrometer, neutral particles and interfering ions that are unnecessary for analysis can be removed in an excellent manner, while ions to be analyzed can be transported efficiently to the subsequent stage for mass spectrometry. As a result, high analytical sensitivity can be realized while interference is eliminated.

REFERENCE SIGNS LIST

1 . . . Chamber
2 . . . Ionization Chamber
3 . . . First Intermediate Vacuum Chamber
4 . . . Second Intermediate Vacuum Chamber
5 . . . High Vacuum Chamber
6 . . . ESI Spray
7 . . . Heating Capillary
8 . . . Skimmer
9 . . . Ion Passage Hole
10 . . . Second Ion Guide
11 . . . Quadrupole Mass Filter
12 . . . Ion Detector
13 . . . First Ion Guide Voltage Generation Unit
14 . . . Second Ion Guide Voltage Generation Unit
15 . . . Mass Filter Voltage Generation Unit
16 . . . Control Unit
20, 30, 40, 50 . . . First Ion Guide (Ion Guide)
201, 501 . . . First Central Axis
202, 502 . . . Second Central Axis
203 . . . Regular Hexagon
204, 304 . . . Rectangle
211 to 216, 311 to 318, 411 to 422, 511 to 516 . . . Rod Electrode
301, 401 . . . Central Axis
303 . . . Regular Octagon
304 . . . Rectangle
403 . . . Regular Dodecagon
404 . . . Square

The invention claimed is:

1. A mass spectrometer comprising:

an ion transport optical system configured to transport an ion to be analyzed, wherein the ion transport optical system includes N rod electrodes, N being an even number of six or more, arranged to extend in an ion transport direction as a whole, and a voltage generation unit configured to apply predetermined voltages to the N rod electrodes respectively, the N rod electrodes are in an N-pole arrangement on an ion incident side, and, in order that four rod electrodes among the N rod electrodes are in a quadrupole arrangement on an ion emission side, at least two rod electrodes of the four rod electrodes are tilted with respect to a central axis of the N-pole arrangement or the quadrupole arrangement so as to approach the central axis along the ion transport direction, and the voltage generation unit is configured to form an N pole radio-frequency electric field on the ion incident side and to form a quadrupole radio-frequency electric field on an ion emission side by applying radio-frequency voltages having phases inverted between adjacent rod electrodes of the N rod electrodes around an ion optical axis.

2. The mass spectrometer according to claim 1, wherein the voltage generation unit applies the second DC voltage, which has a voltage value larger than that of the first DC voltage, to the (N−4) rod electrodes.

3. The mass spectrometer according to claim 2, wherein a central axis of the N-pole arrangement and a central axis of the quadrupole arrangement are parallel and not located on a straight line, and the ion transport optical system deflects an ion in a direction orthogonal to the two central axes on a way by a difference between the first DC voltage and the second DC voltage.

4. The mass spectrometer according to claim 1, wherein a central axis of the N-pole arrangement and a central axis of the quadrupole arrangement are located on a straight line.

5. The mass spectrometer according to claim 1, wherein the N is an even number in a range of six to twelve.

6. The mass spectrometer according to claim 5, further comprising:

one or more intermediate vacuum chambers between an ionization chamber configured to ionize a sample component in an atmospheric pressure atmosphere and a high vacuum chamber in which a mass separation unit is provided and a high vacuum is maintained, wherein the N rod electrodes are arranged in an intermediate vacuum chamber on a next stage of the ionization chamber.

7. The mass spectrometer according to claim 5, further comprising:

two or more intermediate vacuum chambers between an ionization chamber configured to ionize a sample component in an atmospheric pressure atmosphere and a high vacuum chamber in which a mass separation unit is provided and a high vacuum is maintained, wherein the N rod electrodes are arranged in an intermediate vacuum chamber on a stage subsequent to a next stage of the ionization chamber.

8. The mass spectrometer according to claim 5, further comprising:

a collision cell configured to dissociate ions by making the ions in contact with predetermined gas, wherein the N rod electrodes are arranged in the collision cell.

9. The mass spectrometer according to claim 5, further comprising:

a reaction cell configured to cause an ion to react with predetermined gas, wherein the N rod electrodes are arranged in the reaction cell.

10. The mass spectrometer according to claim 1, wherein the voltage generation unit is further configured to apply a first DC voltage to the four rod electrodes in a quadrupole arrangement on the ion emission side, and to apply a second DC voltage different from the first DC voltage to (N−4) rod electrodes other than the four rod electrodes among the N rod electrodes.

11. A mass spectrometer comprising:

an ion transport optical system configured to transport an ion to be analyzed, wherein the ion transport optical system includes N rod electrodes, N being an even number of six or more, arranged to extend in an ion transport direction as a whole, and a voltage generation unit configured to apply predetermined voltages to the N rod electrodes respectively, the N rod electrodes are in an N-pole arrangement on an ion incident side, and, in order that four rod electrodes among the N rod electrodes are in a quadrupole arrangement on an ion emission side, at least two rod electrodes of the four rod electrodes have a shape bent to approach a central axis of the N-pole arrangement or the quadrupole arrangement in at least a part of lengths of the at least two rod electrodes along the ion transport direction, and the voltage generation unit is configured to form an N pole radio-frequency electric field on the ion incident side and to form a quadrupole radio-frequency electric field on an ion emission side by applying radio-frequency voltages having phases inverted between adjacent rod electrodes of the N rod electrodes around an ion optical axis.

12. The mass spectrometer according to claim 11, wherein the voltage generation unit applies the second DC voltage, which has a voltage value larger than that of the first DC voltage, to the (N−4) rod electrodes.

13. The mass spectrometer according to claim 12, wherein a central axis of the N-pole arrangement and a central axis of the quadrupole arrangement are parallel and not located on a straight line, and the ion transport optical system deflects an ion in a direction orthogonal to the two central axes on a way by a difference between the first DC voltage and the second DC voltage.

14. The mass spectrometer according to claim 11, wherein a central axis of the N-pole arrangement and a central axis of the quadrupole arrangement are located on a straight line.

15. The mass spectrometer according to claim 11, wherein the N is an even number in a range of six to twelve.

16. The mass spectrometer according to claim 15, further comprising:

one or more intermediate vacuum chambers between an ionization chamber configured to ionize a sample component in an atmospheric pressure atmosphere and a high vacuum chamber in which a mass separation unit is provided and a high vacuum is maintained, wherein the N rod electrodes are arranged in an intermediate vacuum chamber on a next stage of the ionization chamber.

17. The mass spectrometer according to claim 15, further comprising:

two or more intermediate vacuum chambers between an ionization chamber configured to ionize a sample component in an atmospheric pressure atmosphere and a high vacuum chamber in which a mass separation unit is provided and a high vacuum is maintained, wherein the N rod electrodes are arranged in an intermediate vacuum chamber on a stage subsequent to a next stage of the ionization chamber.

18. The mass spectrometer according to claim 15, further comprising:

a collision cell configured to dissociate ions by making the ions in contact with predetermined gas, wherein the N rod electrodes are arranged in the collision cell.

19. The mass spectrometer according to claim 15, further comprising:

a reaction cell configured to cause an ion to react with predetermined gas, wherein the N rod electrodes are arranged in the reaction cell.

20. The mass spectrometer according to claim 11, wherein the voltage generation unit is further configured to apply a first DC voltage to the four rod electrodes in a quadrupole arrangement on the ion emission side, and to apply a second DC voltage different from the first DC voltage to (N−4) rod electrodes other than the four rod electrodes among the N rod electrodes.

* * * * *